US006010044A

United States Patent [19]

Hsiao

[11] Patent Number: 6,010,044

[45] Date of Patent: Jan. 4, 2000

[54] GLOVE HANGER

[75] Inventor: Louis Hsiao, Palo Alto, Calif.

[73] Assignee: Concept Designs, Inc., Mountain View, Calif.

[21] Appl. No.: 09/256,327

[22] Filed: Feb. 23, 1999

[51] Int. Cl.[7] ..... A47G 25/14

[52] U.S. Cl. ..... 223/85; 223/78

[58] Field of Search ..... 223/85, 92, 88, 223/DIG. 1, 78; 211/113; D6/315

[56] References Cited

U.S. PATENT DOCUMENTS

| | | | |
|---|---|---|---|
| 4,632,285 | 12/1986 | Dillingham | 223/DIG. 1 |
| 4,697,724 | 10/1987 | Pitcher | 223/78 |
| 4,768,657 | 9/1988 | Lonow | 24/34 |
| 5,054,066 | 10/1991 | Blanchard | 223/88 |
| 5,056,693 | 10/1991 | DeBoe | 223/88 |
| 5,117,508 | 6/1992 | Gunter | 2/160 |
| 5,161,720 | 11/1992 | Kolton et al. | 223/DIG. 1 |
| 5,163,590 | 11/1992 | Lawler et al. | 223/88 |
| 5,261,580 | 11/1993 | Smith | 223/85 |
| 5,282,553 | 2/1994 | Ibled | 223/85 |
| 5,480,075 | 1/1996 | Robinson | 223/88 |
| 5,503,269 | 4/1996 | DeBiasio | 206/296 |
| 5,810,216 | 9/1998 | Leopold | 223/85 |

*Primary Examiner*—Bibhu Mohanty
*Attorney, Agent, or Firm*—Skjerven, Morrill, MacPherson, Franklin & Friel LLP; Peter H. Kang; Hugh H. Matsubayashi

[57] ABSTRACT

A device for shipping, displaying, and storing gloves in which a rack or hanger having a central axial body portion, a retaining portion, and two upright inserting portions, or arms, are used for mounting a pair of bulky gloves, such as those used for playing hockey. The gloves are retained on closely aligned arms, which hold the gloves upright with their palms facing inward, thus prominently displaying the backhand side of the gloves while providing secure, dense packing of the gloves. The hanger is suitable for shipping, displaying, and storing of a pair of gloves. The hanger is formed of a single steel wire, bent to form each portion of the hanger, thus providing a strong, aesthetically pleasing, and cost-effective product.

29 Claims, 5 Drawing Sheets

GLOVE HANGER

FIELD OF THE INVENTION

This invention relates generally to the field of racks and hangers for the shipping, display, or storage of gloves. More particularly, this invention relates to the field of racks for the display and shipping of padded or protective gloves, such as those used in sports such as ice hockey.

BACKGROUND OF THE INVENTION

The gloves worn while participating in sports such as ice hockey are typically large and heavily padded to provide protection for the hands of the wearer. As a result, ice hockey gloves are bulky and do not easily compress, making them awkward to deliver and display in a retail display environment. Gloves used for skiing or snowboarding are similarly bulky and difficult to display.

In the past, hockey gloves have been shipped from the manufacturer or wholesaler to the retailer in large boxes, each glove or pair of gloves being contained within a plastic bag. The retailer then removes these bagged gloves from the box and prepares them for presentation on the retail floor. One simple method of displaying the gloves is to place them loosely in a box or bin. This forces the shopper to sort through a pile of gloves in order to find the right size or style glove and makes it more problematic for the retailer to keep matching pairs of gloves together. Alternatively, the gloves can be loosely laid on shelves, however, this also does not solve the problem of keeping pairs of gloves together. Yet another method is to hang the gloves from clips provided on a conventional hanger normally used for hanging clothing.

The above-described methods, in addition to being awkward to sort and search through, fail to present the gloves to the consumer in an aesthetically attractive way. It is important to many retailers that their products be displayed to shoppers in a way that attracts attention and facilitates selection and purchase. This is particularly true in the market for consumer sports equipment, where style and appearance factor heavily into the purchasers' decision-making processes.

Another method for displaying hockey gloves has been to use skewers or rods 12 protruding orthogonally from a wall 10 of a showroom. This method of display is illustrated in FIGS. 1*a*–1*b*. While this method may be more effective than the previously-described method at drawing attention to the particular glove 14 being exhibited, this method also has shortcomings.

First, when a glove 14 protrudes out from a wall 10 directly in front of the customer, the customer views the glove 14 from an odd perspective, revealing only the tops of the finger portion of the glove 14. From a user's or potential buyer's point of view, however, the primary profile of a hockey glove is the portion of the glove covering the back of the hand and the first set of knuckles. This backhand portion is the portion that is normally seen by others when the glove is in use. Accordingly, this backhand portion of the glove is typically where a manufacturer's name or logo is placed, and is where many of a glove's stylistic or design features are concentrated. When the glove 14 is mounted protruding horizontally from the wall 10 at eye level, the primary profile generally cannot be seen unless the glove is removed from the rod 12.

A second problem is that only one glove 14 is supported by each rod 12. Accordingly, if the retailer wishes to display more than one glove 14 at a time, each glove 14 must be individually placed on a separate rod 12. A related problem is the difficulty in displaying multiple pairs of gloves using this method. The store must provide a wall with multiple skewers 12 protruding therefrom. Because each skewer holds only one glove, the retailer must incur additional costs for providing two skewers 12 for each pair of glove. Next, someone must individually place each glove on each skewer. Some method must also be developed for effectively keeping pairs of gloves together.

A further disadvantage of this method for displaying gloves is that the purchaser of the gloves does not receive any storage device for the gloves when they are brought home from the retailer.

Another method for hanging gloves is illustrated in FIG. 2. Here, a hanger 20 is provided having two arms 22*a*–22*b*. Loops 24*a*–24*b* are provided on the gloves 26*a*–26*b* and are used for hanging the gloves 26*a*–26*b* upside-down from the arms 22*a*–22*b*. For the purposes of this discussion, the bottom end 27 of a glove 26*a*–26*b* is considered to be the wrist portion of the glove 26*a*–26*b*, where the wearer's hand is inserted. The top end 28 of a glove 26*a*–26*b* is considered to be the finger portion of the glove 26*a*–26*b*. Accordingly, a glove 26*a*–26*b* displayed with the wrist portion above the finger portion is considered to be upside-down.

While this hanger 20 more effectively displays the primary profile of the gloves 26*a*–26*b*, the gloves 26*a*–26*b* are simply suspended such that they hang loosely from the rack 20. This loose dangling is not conducive to dense packing of the gloves 26*a*–26*b*, which is important during shipping of the gloves 26*a*–26*b* to the retailer. Nor does such a method allow for high-density display of the gloves 26*a*–26*b* on the retail floor. Additionally, this type of rack can only be used with gloves 26*a*–26*b* that are provided with hanging loops 24*a*–24*b*.

Accordingly, there is a clear need for an improved method of shipping, displaying, and storing bulky gloves, such as hockey or skiing gloves.

SUMMARY OF THE INVENTION

In accordance with the present invention, a hanger for gloves is provided in which two arm portions, or inserting portions, connected to a main body portion are provided for insertion into the interiors of a pair of gloves. These arms are positioned such that the gloves are aligned in an upright position, providing improved display of the primary profile of the gloves.

In one embodiment, the first and second inserting portions of the hanger are positioned parallel to, and in close proximity with, the body portion of the hanger, thereby positioning the gloves closely, with the palm portions opposing each other.

In another aspect of the present invention, a method for hanging gloves comprises providing a hanger having a central axial body portion with a vertical axis, a retaining portion provided at an upper end of the vertical axis of the central axial body portion, a first inserting portion connected to a bottom end of the vertical axis of the central axial body portion through a first connector, and a second inserting portion connected to the bottom end of the vertical axis of the central axial body portion through a second connector. Next, the first inserting portion is inserted into an interior portion of a first glove, thereby retaining the first glove in an upright position, and the second inserting portion is inserted into an interior portion of a second glove, thereby retaining the second glove in an upright position.

BRIEF DESCRIPTION OF THE DRAWINGS

The use of the same reference symbols in different drawings indicates similar or identical items.

DETAILED DESCRIPTION

Figure 1A:
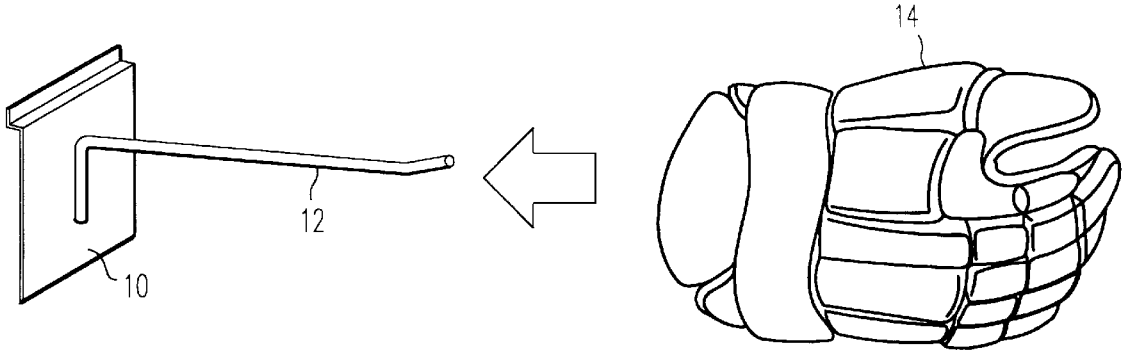
FIG. 1a (Prior Art)
FIGS. 1*a*–1*b* illustrate a prior art method for displaying hockey gloves.
Figure 1B:
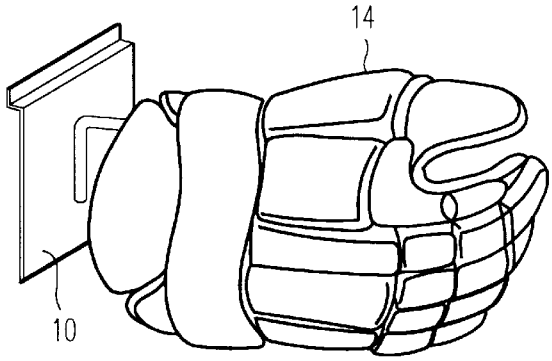
FIG. 1b (Prior Art)
Figure 2:
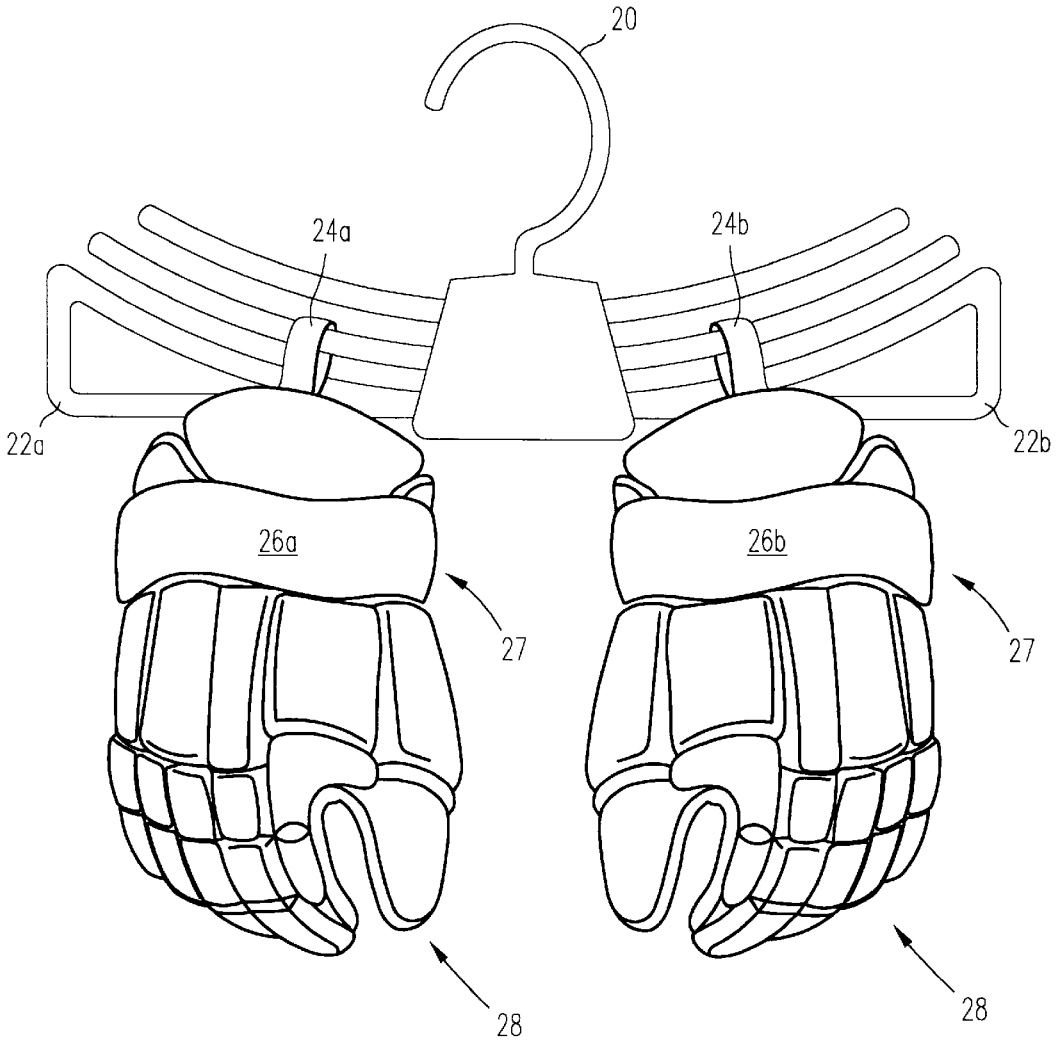
FIG. 2 (Prior Art)
FIG. 2 illustrates another prior art hockey glove hanger.
Figure 3A:
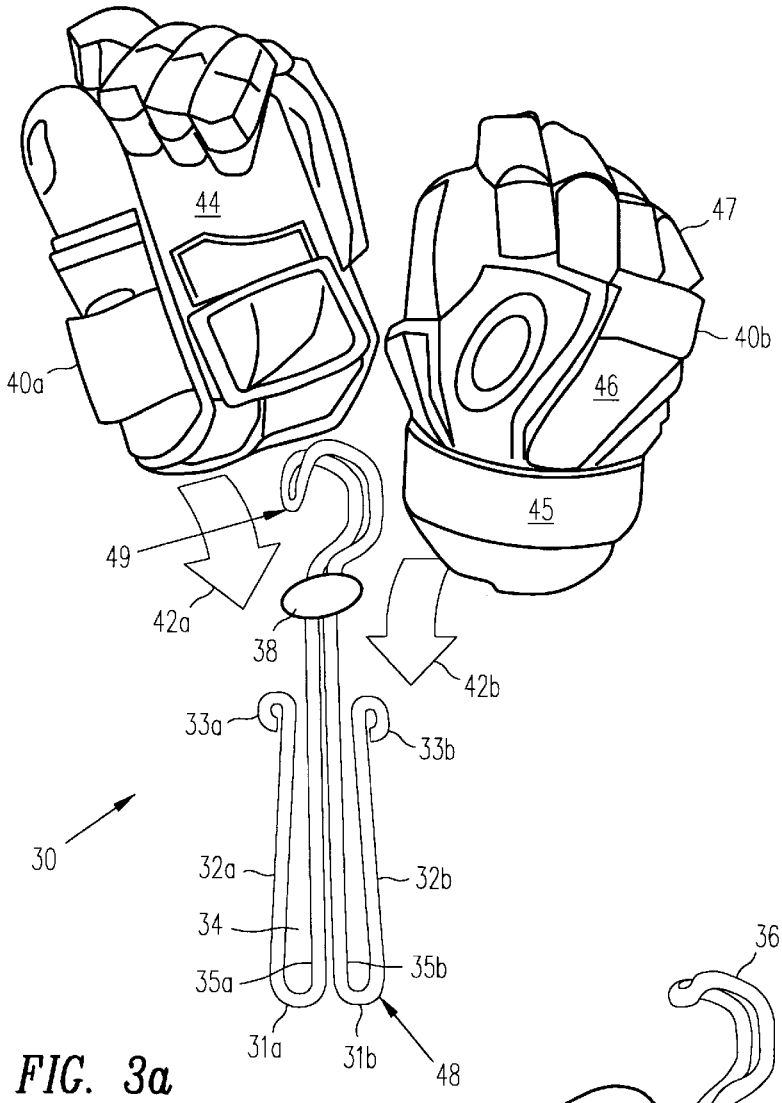
FIGS. 3*a*–3*b* illustrate a hanger in accordance with the present invention.

FIG. 3*a* shows a rack or hanger 30 in accordance with one embodiment of the present invention. The hanger 30 includes a vertically-oriented central body 34, having a longitudinal axis. Central body 34 has an elongated shape, and is provided with a bottom end 48 and a top end 49. The bottom end 48 of the body 34 connects through curved portions 31*a*–31*b* with the bottom end of a first inserting portion 32*a* and a second inserting portion 32*b*. The inserting portions, or arms, 32*a*–32*b* are substantially vertically-oriented, having longitudinal axes adjacent and substantially parallel to the body 34 and each other. The top end 49 of the body 34 is connected to a retaining member, shown in FIG. 3 as a hook 36. The hook 36 can be used to suspend the hanger 30 from a rod or stud for display on the floor of a retail store.

Figure 3B:
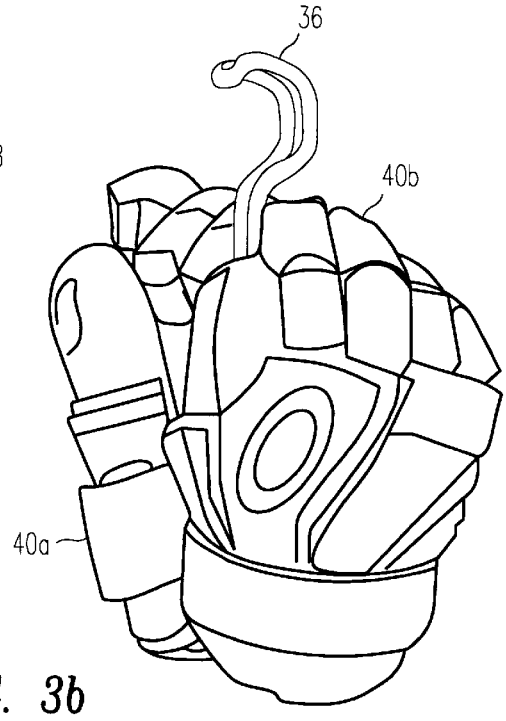

In the embodiment shown in FIGS. 3*a*–3*b*, the hanger 30 is formed of a unitary length of material; in this case the hanger 30 is a single, cylindrical length of steel, bent to form each portion of the hanger 30. This steel rod may be, for example, six gauge cold rolled steel wire. The rod may additionally be finished with zinc plating to prevent corrosion. Steel wire has the advantages of high strength combined with cost-effectiveness and relatively simple manufacturing. Alternatively, plastic may be used to form the hanger 30. One skilled in the art would understand that a wide variety of materials may be substituted for the steel wire, such as wood, other metals or alloys, thermoplastics, resin, ceramics, polymers, or any combination or composite of any such materials.

In FIG. 3*a*, a curve 33*a* is formed at one end of the length of steel to form the top of the first inserting portion 32*a*. The curve 33*a* turns the end of the steel rod inward so that the metal does not snag or damage the interior of the glove 40*a* as it is placed on the hanger 30.

In FIG. 3*a*, the steel rod proceeds straight down from curve 33*a* to form the longitudinal axis of the first inserting portion 32*a*, and is bent in a roughly semicircular arc to form the curved connection 31*a* between the first inserting portion 32*a* and the first half 35*a* of the central body 34. While the first inserting portion 32*a* is substantially parallel to the longitudinal axis of central body 34, in one embodiment, the longitudinal axis of the first inserting portion 32*a* is slightly askew such that the top end of the arm 32*a* is closer to the central body 34 than the bottom end of arm 32*a*. This skewed arrangement of first inserting portion 32*a* creates a "pinching" effect, which helps to securely retain the glove 40*a* on the hanger 30. Alternatively, the longitudinal axes of arms 32*a*–32*b* may be slightly angled such that the top ends of the arms 32*a*–32*b* are farther from the central body 34 than the bottom ends, thereby facilitating easier insertion of the arms 32*a*–32*b* into the gloves 40*a*–40*b*. In either embodiment, the arms 32*a*–32*b* and curved connections 31*a*–31*b* are formed to provide some flexibility to allow for improved mounting and unmounting of the gloves 40*a*–40*b*. Alternatively, the arms 32*a*–32*b* and curved connections 31*a*–31*b* are rigidly formed to prevent flexure during use.

In FIG. 3*a*, the steel rod forms one portion of the central body 34, extending vertically from the bottom end 48 to the top end 49. At the top end 49 of the central body 34, the steel rod is bent into a curve to form the hook 36. In this embodiment, the steel rod extends downward from the top end 49 to then form another straight portion to provide the second half 35*b* of the central body 34. The rod then bends at the bottom end 48 of the central body 34 to form a second semicircular curved portion 31*b* connecting the central body 34 with the second inserting portion 32*b*. The steel rod then extends substantially vertically away from the curved portion 31*b* and terminates in a curve 33*b*, which is similar to curve 33*a*.

The above description regarding the formation of the hanger 30 out of the single length of metal rod may suggest that each bend in the metal is formed in a serial fashion, one bend after the other. In practice, however, the hanger 30 is formed using any type of metal working process known in the art. The invention is not limited by the method which the hanger 30 is formed or molded, nor is the invention limited by the sequence in which the portions of the hanger 30 are formed or how those portions are connected. Alternatively, the hanger 30 may be made of carved wood or molded plastic and the invention is not limited by the material or materials out of which hanger 30 may be fashioned. The hanger may also be formed of multiple sections which are assembled to form the complete hanger.

In one embodiment, the first and second inserting portions 32*a*–32*b* are approximately 8" long and are spaced approximately 1.25" away from the central body 34. The central body 34 in this embodiment is approximately 9.5" long and the hook 36 is approximately 3.5" long, making the entire hanger 30 approximately 13" long. These dimensions are for illustrative purposes only, and the hanger 30 can be formed in any size suitable for supporting the type of gloves 40*a*–40*b* being displayed.

The gloves 40*a*–40*b* shown in FIGS. 3*a*–3*b* are of the type normally worn while playing ice hockey. Each glove 40*a*–40*b* has a palm side 44 and a backhand side 46, both sides being heavily padded for impact protection. The gloves 40*a*–40*b* also include a wrist portion 45 that provides an opening through which the wearer's hand is inserted. For the purposes of this patent, the wrist portion 45 is considered to be the "lower" end of the gloves 40*a*–40*b*, and the portion 47 where the wearer's fingers are inserted is considered to be the "upper" end. While the gloves 40*a*–40*b* are generally referred as being of the type used for ice hockey, the present invention can be used as a rack for any type of glove, in particular those used for athletics in which bulky padding and/or dampness is an issue. For example, this invention can accommodate gloves used for all types of hockey, skiing, snowboarding, lacrosse, boxing, and any protective gloves used in industry or the military. The dimensions of the hanger 30 used for each of these applications may be varied in order to better customize the hanger 30 for the glove being mounted.

The gloves 40*a*–40*b* are mounted onto the hanger 30 by sliding them downwards in the direction of the arrows 42*a*–42*b* to insert the first inserting portion 32*a* through the opening in the wrist portion 45 into the interior of the left glove 40*a* and the second inserting portion 32*b* through the wrist portion 45 and into the interior of the right glove 40*b*. The gloves 40*a*–40*b* are mounted onto the hanger 30 such that the palm side 44 of each glove 40*a*–40*b* faces inward towards the central body 34, leaving the backhand side 46 on the exterior. One example of mounted gloves 40*a*–40*b* is shown in FIG. 3*b*.

Mounting the gloves 40*a*–40*b* palm side 44 inward on closely spaced, parallel arms 32*a*–32*b* enables prominent display of the backhand side 46 primary profile of the gloves 40*a*–40*b*, while keeping the pair of gloves 32*a*–32*b* together and densely packed.

A further advantage of the present invention is that the hanger 30 may be used for shipping the gloves 32*a*–32*b* from the manufacturer or wholesaler to the retailer. The gloves 32*a*–32*b* may arrive at the retail store pre-mounted on hangers 30, thus eliminating the need for sorting and re-mounting, enabling rapid restocking on the retail floor and increasing efficiency.

Yet another advantage of the present invention is that it provides the end purchaser with an effective way of storing gloves 40*a*–40*b* between uses. The gloves 40*a*–40*b* can be placed on the hanger 30 in a locker or closet at home, rather than being left loose on the floor, shelf, or in a drawer.

In addition, hockey is an extremely physical sport, and hockey gloves tend to become drenched with perspiration during use. Ski and snowboarding gloves also become soaked with water and perspiration during use. Virtually all gloves become moist after some period of usage. Moist gloves can be placed on the hanger 30 in an appropriate location for drying or storage. Storing the gloves 40*a*–40*b* upright after such use effectuates rapid drying by using gravity to pull the moisture downward towards the opening in the wrists 45 of the gloves 40*a*–40*b*, rather than towards the fingers, as would occur if the gloves 40*a*–40*b* were suspended upside down. Moisture collected at the wrist portion of the gloves 40*a*–40*b* evaporates more quickly than moisture at the fingers because of increased exposure to the ambient air. After the gloves 40*a*–40*b* have dried, they can then be left on the hanger 30 for storage in a closet or locker until their next use.

In one alternative embodiment, as shown in FIG. 3A, a plate 38 may be provided on the hanger 30. The plate 38 is attached near the top of the central body 34 and is fixedly attached to both the first half 35*a* and second half 35*b* of the central body 34. The plate 38 can be used to provide additional support and reinforcement for the hanger structure, and can also be used to display information about the gloves, retailer, or owner, such as a brand logo or name.

Figure 4:
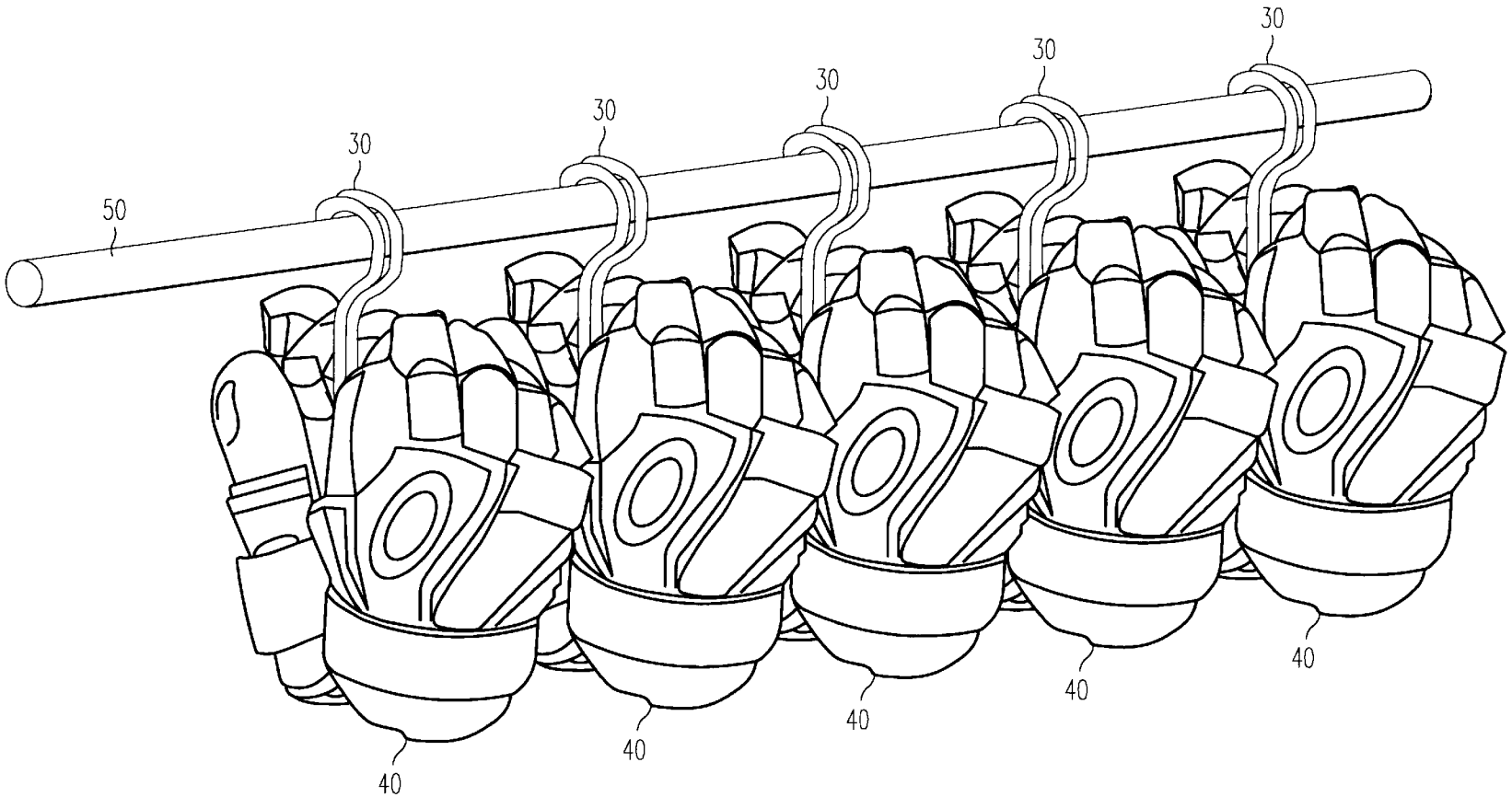
FIG. 4 illustrates a plurality of hangers in accordance with the present invention.

FIG. 4 illustrates multiple gloves 40 being displayed on a plurality of hangers 30 suspended from a rod 50. This is one example of how a plurality of gloves 40 may be displayed at a retail store using a plurality of hangers 30.

Figure 5:
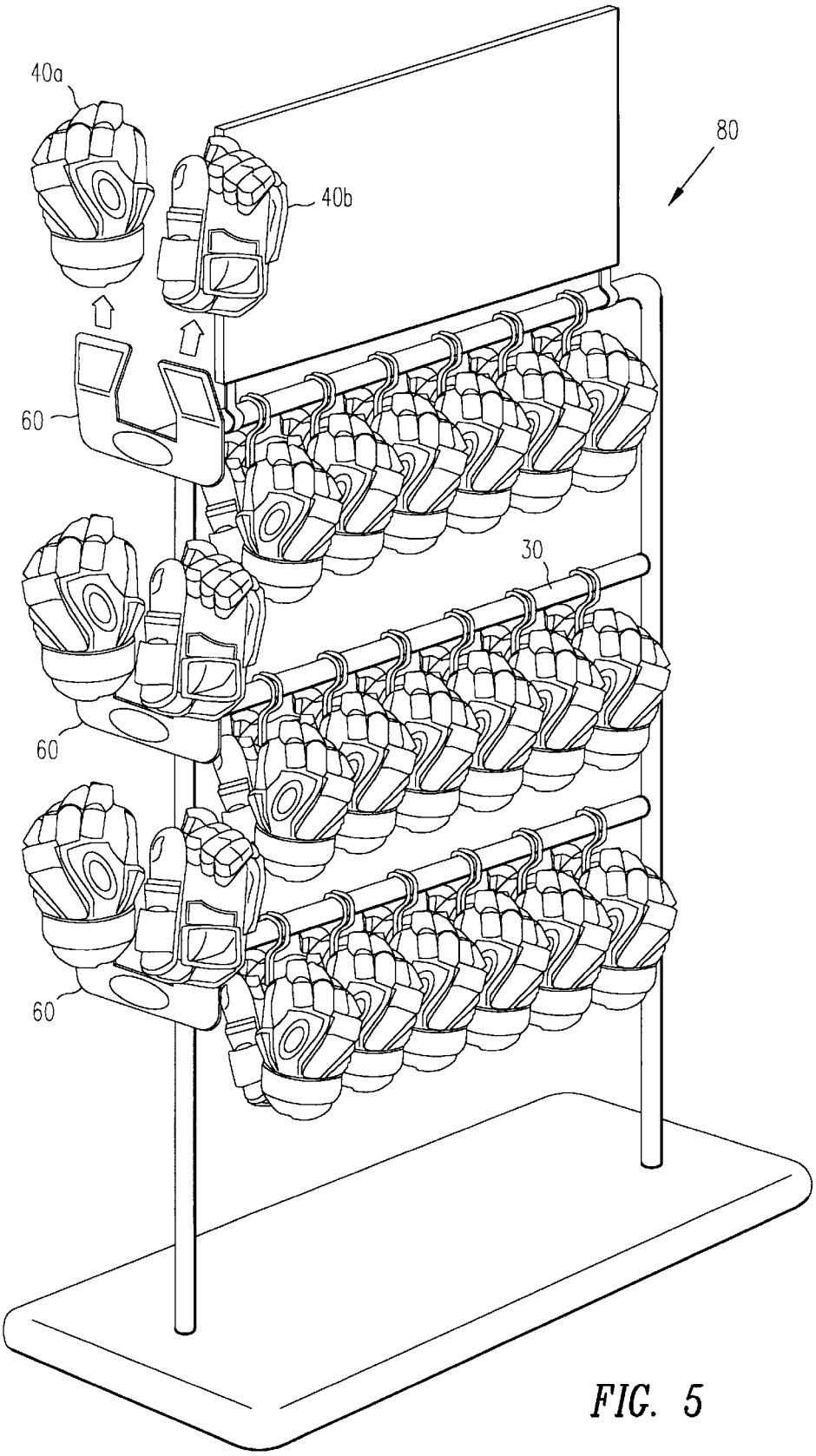
FIG. 5 illustrates another exemplary arrangement of a plurality of hangers in accordance with the present invention.

FIG. 5 shows an exemplary display in accordance with the present invention. A full size display 80 includes three plate-shaped racks 60 displaying gloves 40*a*–40*b*, and a plurality of hangers 30. Alternatively, displays incorporating the present invention can include a variety of different arrangements, varying, for example, the number and size of the racks 60, the hangers 30.

Although the invention has been described with reference to particular embodiments, the description is only an example of the invention's application and should not be taken as a limitation. Various adaptations and combinations of the features of the embodiments disclosed are within the scope of the invention as defined by the following claims.

I claim:

1. A hanger for gloves, comprising:

a central axial body having a first end and a second end, said central axial body comprising a first bar and a second bar, the first and second bars being substantially parallel;

a retaining portion provided on the first end of the central axial body;

a first inserting portion having an insertion end and an attachment end distal from said insertion end;

a first connector connecting the attachment end of the first inserting portion to the second end of the first bar of the central axial body;

a second inserting portion having an insertion end and an attachment end distal from said insertion end; and a second connector connecting the attachment end of the second inserting portion to the second end of the second bar of the central axial body wherein the central axial body, the retaining portion the first inserting portion, the second inserting portion, the first connector, and the second connector are integrally formed of a unitary length of material, said unitary length of material comprising:

a first straight portion defining the first inserting portion;

a first curved portion contiguous with the first straight portion, said first curved portion defining the first connector;

a second straight portion contiguous with the first curved portion, said second straight portion defining the first bar of the central axial body;

a second curved portion contiguous with the second straight portion, said second curved portion defining the retaining portion;

a third straight portion contiguous with the second curved portion, said third straight portion defining the second bar of the central axial body;

a third curved portion contiguous with the third straight portion, said third curved portion defining the second connector; and a fourth straight portion contiguous with the third curved portion, said fourth straight portion defining the second inserting portion.

2. The hanger of claim 1, wherein:

said central axial body has a vertical axis and the first end of said central axial body is provided at a top end of the vertical axis;

said first inserting portion has a longitudinal axis substantially parallel and adjacent to the vertical axis of the central axial body;

said second inserting portion has a longitudinal axis substantially parallel and adjacent to both the vertical axis of the central axial body and the vertical axis of the first inserting portion.

3. The hanger of claim 1, wherein said retaining portion comprises a hook formed at the top end of the central axial body.

4. The hanger of claim 1, further comprising a plate connected laterally to said central axial body.

5. The hanger of claim 4, wherein said plate is connected laterally to the central axial body distal from the second end of the central axial body.

6. The hanger of claim 1, wherein:

a distance between the insertion end of said first inserting portion and the central axial body is less than a distance between the attachment end of the first inserting portion and the central axial body; and a distance between the insertion end of the second inserting portion and the central axial body is less than a distance between the attachment end of the second inserting portion and the central axial body.

7. The hanger of claim 1, wherein said unitary length of material is cylindrical in cross-section.

8. The hanger of claim 1, wherein said unitary length of material is metal.

9. The hanger of claim 8, wherein said metal is steel.

10. The hanger of claim 4, wherein said plate is attached to both the second straight portion and the third straight portion of the unitary length of material.

11. A method for hanging gloves, comprising:

providing a hanger, said hanger including:

a central axial body comprising a first bar and a second bar, the first and second bars being substantially parallel;

a U-shaped retaining member formed at a top end of the central axial body, the retaining member having a first end connected to the first bar of the central axial body and a second end connected to the second bar of the central axial body;

a first inserting portion connected to a bottom end of the first bar of the central axial body portion through a first curved portion; and a second inserting portion connected to a bottom end of the second bar of the central axial body through a second curved portion;

wherein the central axial body, the retaining member, the first inserting portion, the second inserting portion, the first curved portion, and the second curved portion are integrally formed of a unitary length of material;

inserting the first inserting portion into an interior portion of a first glove, thereby retaining the first glove; and inserting the second inserting portion into an interior portion of a second glove, thereby retaining the second glove.

12. The method of claim 11, wherein the first glove and second glove are retained such that a palm portion of the first glove faces a palm portion of the second glove.

13. The method of claim 11, wherein the first glove and the second glove are hockey gloves.

14. The method of claim 11, wherein:

a wrist portion of the first glove is supported by the first curved portion; and a wrist portion of the second glove is supported by the second curved portion.

15. A hanger for gloves, comprising:

a central axial body comprising a first bar and a second bar, the first and second bars being substantially parallel;

a U-shaped retaining member formed at a top end of the central axial body, the retaining member having a first end connected to the first bar of the central axial body and a second end connected to the second bar of the central axial body;

a first inserting bar connected with a bottom end of the first bar of the central axial body through a first curved portion; and a second inserting bar connected with a bottom end of the second bar of the central axial body through a second curved portion;

wherein the central axial body, the retaining member, the first inserting bar, the second inserting bar, the first curved portion, and the second curved portion are integrally formed of a unitary length of material.

16. The hanger of claim 15, wherein said unitary length of material is metal.

17. The hanger of claim 16, wherein said metal is steel.

18. The hanger of claim 15, wherein said unitary length of material is cylindrical in cross-section.

19. The hanger of claim 15, further comprising a plate connected laterally to said central axial body.

20. The hanger of claim 19, wherein said plate is attached to both the first bar of the central axial body and the second bar of the central axial body.

21. A system for hanging gloves, comprising:

a central axial body comprising a first bar and a second bar, the first and second bars being substantially parallel;

a U-shaped retaining member formed at a top end of the central axial body, the retaining member being a having a first end connected to the first bar of the central axial body and a second end connected to the second bar of the central axial body;

a first glove having an interior region;

a first inserting bar connected with a bottom end of the first bar of the central axial body through a first curved portion, the first inserting bar being positioned inside the interior region of the first glove, thereby maintaining the first glove in an upright position;

a second glove having an interior region; and a second inserting bar connected with a bottom end of the second bar of the central axial body through a second curved portion, the second inserting bar being positioned inside the interior region of the second glove, thereby maintaining the second glove in an upright position;

wherein the central axial body, the retaining member, the first inserting bar, the second inserting bar, the first curved portion, and the second curved portion are integrally formed of a unitary length of material.

22. The system of claim 21, wherein:

a wrist portion of the first glove is supported by the first curved portion; and a wrist portion of the second glove is supported by the second curved portion.

23. The system of claim 21, wherein said unitary length of material is metal.

24. The system of claim 23, wherein said metal is steel.

25. The system of claim 21, wherein said unitary length of material is cylindrical in cross-section.

26. The system of claim 21, further comprising a plate connected laterally to said central axial body.

27. The system of claim 26, wherein said plate is attached to both the first bar of the central axial body and the second bar of the central axial body.

28. The system of claim 21, wherein the first glove and second glove are retained such that a palm portion of the first glove faces a palm portion of the second glove.

29. The system of claim 21, wherein the first glove and the second glove are hockey gloves.

* * * * *